US006241191B1

(12) United States Patent
Coronado

(10) Patent No.: US 6,241,191 B1
(45) Date of Patent: Jun. 5, 2001

(54) AMBIDEXTROUS REEL ASSEMBLY FOR SIMULTANEOUSLY CONTROLLING CORD WINDINGS OF MULTIPLE KITES FLYING IN UNISON

(76) Inventor: Pedro Coronado, 328 61ST D2, West New York, NJ (US) 07093

( * ) Notice: Subject to any disclaimer, the term of this patent is extended or adjusted under 35 U.S.C. 154(b) by 0 days.

(21) Appl. No.: 09/422,217

(22) Filed: Oct. 21, 1999

(51) Int. Cl.[7] ..... B64C 31/06
(52) U.S. Cl. ..... 244/155 A; 244/155 R
(58) Field of Search ..... 244/155 R, 155 A, 244/153 R

(56) References Cited

U.S. PATENT DOCUMENTS 5,024,401 * 6/1991 Nakashima ..... 244/155 A
5,120,006 * 6/1992 Hadzicki ..... 244/155 R
5,180,123 * 1/1993 Lin ..... 244/155 A

* cited by examiner

*Primary Examiner*—Charles T. Jordan

(57) ABSTRACT

An ambidextrous reel assembly for simultaneously controlling cord windings of multiple kites flying in unison that includes a frame, a spindle, and a crank. The frame forms a rectangular configuration, with one short member thereof having a plurality of guide throughbores spaced therealong. The spindle includes an axle, a pair of side plates that are +-shaped, four cross members so as to form a cage configuration that rotates in the frame, and colored lights that illuminate when the spindle is rotated. The crank includes an automated rotation apparatus that automatically rotates the spindle, and a sound system that plays when the spindle is rotated. When the crank is rotated in one direction, the cage rotates in the one direction, which in turn winds the cords, through the plurality of guide throughbores in the frame, unto the cage, and when rotated in an opposite direction, the cage rotates in the opposite direction, which in turn unwinds the cords, through the plurality of guide throughbores in the frame, from the cage.

17 Claims, 1 Drawing Sheet

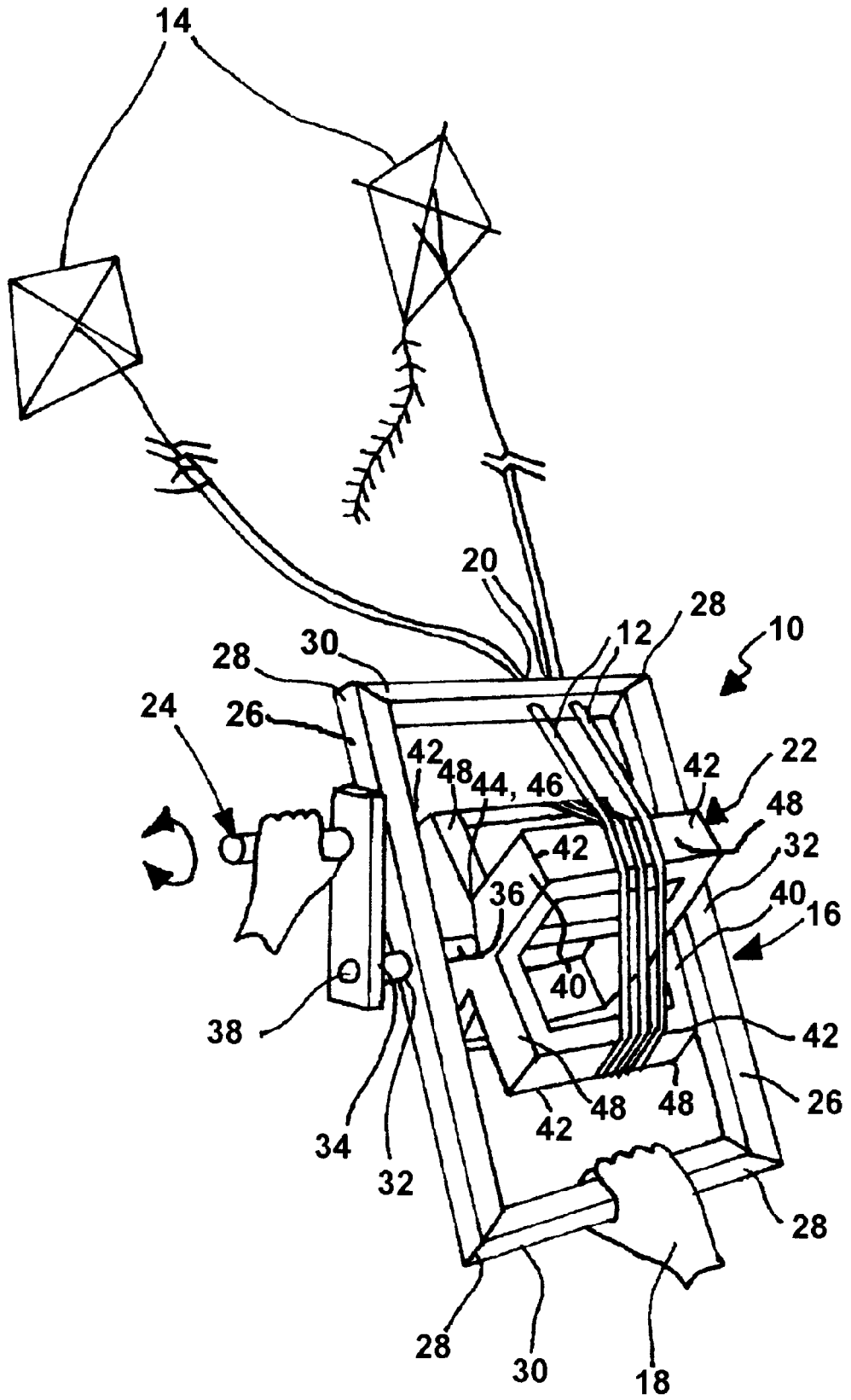
14
20
28
12
10
28
30
24
26
42
48
44, 46
42
22
48
42
32
36
40
16
40
38
42
48
48
26
42
34
32
28
28
30
18

AMBIDEXTROUS REEL ASSEMBLY FOR SIMULTANEOUSLY CONTROLLING CORD WINDINGS OF MULTIPLE KITES FLYING IN UNISON

BACKGROUND OF THE INVENTION

1. Field of the Invention

The present invention relates to a reel assembly. More particularly, the present invention relates to an ambidextrous reel assembly for simultaneously controlling cord windings of multiple kites flying in unison.

2. Description of the Prior Art

Kite flying has been enjoyed as a pleasurable activity for many centuries and today still remains a widely enjoyable pastime and sport.

One limitation in the full enjoyment of such activity, however, is the difficulty involved in winding and unwinding the lite line cord. This problem in its simplest form involves the difficulty and tedium of winding or unwinding lengthy sections of line cord quickly and rapidly without snarling or tangling the line and possibly breaking the line.

Such problem in its more complex form involves the further difficulties in controlling kite operations through proper and quick manipulation of the line cord so as to achieve the desired upward and downward movement quickly or slowly as desired.

Numerous innovations for reel assemblies for kite string have been provided in the prior art that will be described. Even though these innovations may be suitable for the specific individual purposes to which they address, however, they differ from the present invention in that they do not teach an ambidextrous reel assembly for simultaneously controlling cord windings of multiple flying kites.

FOR EXAMPLE, U.S. Pat. No. 4,176,806 to Kwon teaches a reel assembly for controlling line cord winding in kite flying that includes an elongated main hand hold member adapted for controlling the winding of the reel assembly and a spool member adapted for receiving, storing, and releasing the cord. The spool member includes a plurality of secondary hand hold members extending axially with respect to the spool member. At least one support member extends radially from the central axis of the spool member for fixably mounting the secondary hand hold members spaced remotely from each other and from the axis of the spool member.

The main hand hold member extends axially through the center of the support members and remotely from the spool member. An axle extends from the main hand hold member for supporting the spool member, which is releasably locked to the axle by a clutch mechanism.

ANOTHER EXAMPLE, U.S. Pat. No. 4,238,086 to Brimmeier teaches a kite string reel device, including a reel or spool rotated manually by means of a crank handle, the reel being supported inside a box-like frame or housing, and the reel, in one design, being adjustable for handling different lengths of string, by having an adjustable sized hub.

STILL ANOTHER EXAMPLE, U.S. Pat. No. 4,714,217 to Prentice teaches a take up device for the control of kites by multiple lines includes two control handles removably fixable to an axle such that the control lines, individually affixed to either of the handles may be simultaneously retrieved with the handles affixed to the axle.

YET ANOTHER EXAMPLE, U.S. Pat. No. 4,915,320 to Neal teaches a kite string reel, suitable for manual operation and also suitable for power-driven operation by reason of its adaptation for use with a cordless screwdriver having a mouth for accepting interchangeable bits. The kite string reel contains a hollow spool having two flanges. One flange is an annular ring while the other flange is a circular disc. The circular disc has a handle extending away from the spool and a bit extending inward. A removable handle is adapted to fit into the open end of the spool for manual operation or, if power-driven operation is desired, a cordless screw driver can instead be inserted.

It is apparent that numerous innovations for reel assemblies for kite string have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an ambidextrous reel assembly for simultaneously controlling cord windings of multiple kites flying in unison that avoids the disadvantages of the prior art.

ANOTHER OBJECT of the present invention is to provide an ambidextrous reel assembly for simultaneously controlling cord windings of multiple kites flying in unison that is simple and inexpensive to manufacture.

STILL ANOTHER OBJECT of the present invention is to provide an ambidextrous reel assembly for simultaneously controlling cord windings of multiple kites flying in unison that is simple to use.

BRIEFLY STATED, YET ANOTHER OBJECT of the present invention is to provide an ambidextrous reel assembly for simultaneously controlling cord windings of multiple kites flying in unison that includes a frame, a spindle, and a crank. The frame forms a rectangular configuration, with one short member thereof having a plurality of guide throughbores spaced therealong. The spindle includes an axle, a pair of side plates that are +-shaped, four cross members so as to form a cage configuration that rotates in the frame, and colored lights that illuminate when the spindle is rotated. The crank includes an automated rotation apparatus that automatically rotates the spindle, and a sound system that plays when the spindle is rotated. When the crank is rotated in one direction, the cage rotates in the one direction, which in turn winds the cords, through the plurality of guide throughbores in the frame, unto the cage, and when rotated in an opposite direction, the cage rotates in the opposite direction, which in turn unwinds the cords, through the plurality of guide throughbores in the frame, from the cage.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The sole FIGURE of the drawing is a diagrammatic perspective view of the present invention in use.

LIST OF REFERENCE NUMERALS UTILIZED IN THE DRAWING

10 ambidextrous reel assembly of the present invention for simultaneously controlling cord 12 windings of multiple kites 14 flying in unison

12 cords
14 multiple kites
16 frame for holding in one hand 18
20 plurality of guide throughbores in frame 16
22 spindle for winding and unwinding cords 12 of multiple kites 14 through plurality of throughbores 20 in frame 16
24 crank for rotation by the other hand
26 pair of long members of frame 16
28 pair of terminal ends of each long member of pair of long members 26 of frame 16
30 pair of short members of frame 16
32 midpoint of each long member of pair of long members 26 of frame 16
34 bearing throughbore in midpoint 32 of each long member of pair of long members 26 of frame 16
36 axle of spindle 22
38 terminal end of axle 36 of spindle 22
40 pair of side plates of spindle 22
42 four terminal ends of each side plate of pair of side plates 40 of spindle 22
44 midpoint of each side plate of pair of side plates 40 of spindle 22
46 axle throughbore in midpoint 44 of each side plate of pair of side plates 40 of spindle 22
48 four cross members of spindle 22
50 automated rotation apparatus of crank 24
52 colored lights of spindle 22
54 sound system of crank 24

DETAILED DESCRIPTION OF THE PREFERRED EMBODIMENT

Referring now to the sole FIGURE, which is a diagrammatic perspective view of the present invention in use, the ambidextrous reel assembly of the present invention is shown generally at 10 for simultaneously controlling cord 12 windings of multiple kites 14 flying in unison.

The ambidextrous reel assembly 10 comprises a frame 16 for holding in one hand 18 and having a plurality of guide throughbores 20, a spindle 22 rotatably mounted in the frame 16 for winding and unwinding the cords 12 of the multiple kites 14 through the plurality of throughbores 20 in the frame 16, and a crank 24 connected to the spindle 22 for rotation therewith by the other hand.

The frame 16 comprises a pair of long members 26 that are slender, elongated, and spaced parallel from each other.

Each long member 26 of the frame 16 has a pair of terminal ends 28.

The frame 16 further comprises a pair of short members 30 that are shorter than the pair of long members 26 of the frame 16, are slender, elongated, and spaced parallel from each other, and connect the pair of terminal ends 28 of one long member 26 of the frame 16 to the pair of terminal ends 28 of the other long member 26 of the frame 16, respectively, so as to form a rectangular configuration.

Each long member 26 of the frame 16 has a midpoint 32 that is midway between the pair of terminal ends 28 thereof and which has a bearing throughbore 34.

One short member 30 of the frame 16 has the plurality of guide throughbores 20 spaced therealong.

The spindle 22 comprises an axle 36 that enters rotatively into the bearing throughbore 34 in each long member 26 of the frame 16, and passes past one thereof, to a terminal end 38.

The spindle 22 further comprises a pair of side plates 40.

Each side plate 40 of the spindle 22 is disposed adjacent to, and inward of, a respective long member 26 of the frame 16, is +shaped, and has four terminal ends 42, and a midpoint 44 that is midway between the four terminal ends 42 thereof and which has an axle throughbore 46 that receives the axle 36 of the spindle 22 for rotation therewith.

The spindle 22 further comprises four cross members 48 that are slender, elongated, spaced parallel from each other, and connect the four terminal ends 42 of one side plate 40 of the spindle 22 to the four terminal ends 42 of the other side plate 40 of the spindle 22, respectively, so as to form a cage configuration that rotates in the frame 16.

The crank 24 extends from the terminal end 38 of the axle 36, and when rotated in one direction by the other hand, rotates the axle 36 of the spindle 22 in the one direction, which in turn rotates the cage in the one direction, which in turn winds the cords 12, through the plurality of guide throughbores 20 in the one short member 30 of the frame 16, unto the cage, and when rotated in an opposite direction by the other hand, rotates the axle 36 of the spindle 22 in the opposite direction, which in turn rotates the cage in the opposite direction, which in turn unwinds the cords 12, through the plurality of guide throughbores 20 in the one short member 30 of the frame 16, from the cage.

The crank 24 further comprises an automated rotation apparatus 50 that is operatively connected thereto, and when activated, automatically rotates the spindle 22, and thereby eliminates a need for the other hand to rotate the crank 24.

The spindle 22 further comprises colored lights 52 that are operatively connected to, and disposed thereon, and illuminate when the spindle 22 is rotated.

The illumination of the colored lights 52 of the spindle 22 is either steady, flashing, or in any programmable manner.

The crank 24 further comprises a sound system 54 that is operatively connected thereto, and plays when the spindle 22 is rotated.

It will be understood that each of the elements described above, or two or more together, may also find a useful application in other types of constructions differing from the types described above.

While the invention has been illustrated and described as embodied in an ambidextrous reel assembly for simultaneously controlling cord windings of multiple kites flying in unison, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An ambidextrous reel assembly for simultaneously controlling cord windings of multiple kites flying in unison, comprising:

a) a frame for holding in one hand and having a plurality of guide throughbores;

b) a spindle rotatably mounted in said frame for winding and unwinding the cords of the multiple kites through said plurality of throughbores in said frame; and c) a crank connected to said spindle for rotation therewith by the other hand.

2. The assembly as defined in claim 1, wherein said frame comprises a pair of long members that are slender, elongated, and spaced parallel from each other.

3. The assembly as defined in claim 2, wherein each long member of said frame has a pair of terminal ends.

4. The assembly as defined in claim 3, wherein said frame further comprises a pair of short members that are shorter than said pair of long members of said frame, are slender, elongated, and spaced parallel from each other, and connect said pair of terminal ends of one long member of said frame to said pair of terminal ends of the other long member of said frame, respectively, so as to form a rectangular configuration.

5. The assembly as defined in claim 4, wherein each long member of said frame has a midpoint that is midway between said pair of terminal ends thereof and which has a bearing throughbore.

6. The assembly as defined in claim 4, wherein one short member of said frame has said plurality of guide throughbores spaced therealong.

7. The assembly as defined in claim 5, wherein said spindle comprises an axle that enters rotatively into said bearing throughbore in each long member of said frame, and passes past one thereof, to a terminal end.

8. The assembly as defined in claim 7, wherein said spindle further comprises a pair of side plates.

9. The assembly as defined in claim 8, wherein each side plate of said spindle is disposed adjacent to, and inward of, a respective long member of said frame, is +-shaped, and has:

a) four terminal ends; and b) a midpoint that is midway between said four terminal ends thereof and which has an axle throughbore that receives said axle of said spindle for rotation therewith.

10. The assembly as defined in claim 9, wherein said spindle further comprises four cross members that are slender, elongated, spaced parallel from each other, and connect said four terminal ends of one side plate of said spindle to said four terminal ends of the other side plate of said spindle, respectively, so as to form a cage configuration that rotates in said frame.

11. The assembly as defined in claim 10, wherein said crank extends from said terminal end of said axle, and when rotated in one direction by the other hand, rotates said axle of said spindle in said one direction, which in turn rotates said cage in said one direction, which in turn winds the cords, through said plurality of guide throughbores in said one short member of said frame, unto said cage, and when rotated in an opposite direction by the other hand, rotates said axle of said spindle in said opposite direction, which in turn rotates said cage in said opposite direction, which in turn unwinds the cords, through said plurality of guide throughbores in said one short member of said frame, from said cage.

12. The assembly as defined in claim 1, wherein said crank further comprises an automated rotation apparatus that is operatively connected thereto, and when activated, automatically rotates said spindle, and thereby eliminates a need for the other hand to rotate said crank.

13. The assembly as defined in claim 1, wherein said spindle further comprises colored lights that are operatively connected to, and disposed thereon, and illuminate when said spindle is rotated.

14. The assembly as defined in claim 13, wherein said illumination of said colored lights of said spindle is steady.

15. The assembly as defined in claim 13, wherein said illumination of said colored lights of said spindle is flashing.

16. The assembly as defined in claim 13, wherein said illumination of said colored lights of said spindle is in any programmable manner.

17. The assembly as defined in claim 1, wherein said crank further comprises a sound system that is operatively connected thereto, and plays when said spindle is rotated.

* * * * *